United States Patent [19]

Honkomp et al.

[11] Patent Number: 5,035,653

[45] Date of Patent: Jul. 30, 1991

[54] TERMINAL BLOCK FOR A HERMETIC TERMINAL ASSEMBLY

[75] Inventors: Glenn A. Honkomp, Warren; Eugene H. Tingley; Thomas O. McNay, both of Clermont, all of Ohio; Benjamin Bowsky, St. Louis, Mo.

[73] Assignee: Emerson Electric Co., St. Louis, Mo.

[21] Appl. No.: 503,232

[22] Filed: Apr. 2, 1990

[51] Int. Cl.[5] ..... H01R 13/68

[52] U.S. Cl. ..... 439/622; 439/685; 439/926

[58] Field of Search ..... 439/622, 678, 685, 686, 439/722, 736, 926, 935

[56] References Cited

U.S. PATENT DOCUMENTS

| | | | |
|---|---|---|---|
| 3,160,460 | 12/1964 | Wyzenbeek . | |
| 3,622,948 | 11/1971 | Foster | 439/622 |
| 4,109,992 | 8/1978 | Hughes et al. | 439/685 X |
| 4,461,925 | 7/1984 | Bowsky et al. | 174/152 GM |
| 4,584,433 | 4/1986 | Bowsky et al. | 174/152 GM |
| 4,609,774 | 9/1986 | LeMieux et al. | 174/152 GM |
| 4,739,551 | 4/1988 | Bowsky et al. | 29/882 |
| 4,752,243 | 6/1988 | Meidan | 439/622 |
| 4,753,607 | 6/1988 | Heinbrock | 439/685 X |

*Primary Examiner*—Eugene F. Desmond

*Attorney, Agent, or Firm*—Polster, Polster and Lucchesi

[57] ABSTRACT

A current resistive terminal block for connection to outer pin segment means projecting outwardly from a body member of a hermetic terminal assembly sealed in a housing wall, the terminal block including a main channel means to protect the outer pin segment means and diffuse possible leakage from the terminal assembly and subchannel means to encase and secure fused lead end wire connection means for the outer pin segment means.

9 Claims, 2 Drawing Sheets

TERMINAL BLOCK FOR A HERMETIC TERMINAL ASSEMBLY

BACKGROUND OF THE INVENTION

The present invention relates to hermetic terminal assemblies and more particularly to an improved terminal block arrangement for a hermetic terminal assembly.

It is known in the art of hermetic terminal assemblies to employ a current carrying electrically connected terminal pin, which pin incorporates a reduced fuse-like area generally located on the inner segment of the pin on the inner dish side face of a cup-shaped body of the terminal assembly. The cup-shaped body, in turn, is mounted in sealed relation on a housing wall with the inner segment of the pin being confined therein. It also is known in the art, to include a stop flange between the extremity of the inner segment of the pin and such fuse-like area within the cup-shaped body in the event such fuse-like area should melt because of abnormally excessive current conditions. In this regard, attention is directed to U.S. Pat. Nos. 4,584,433 issued to Benjamin Bowsky et al. on Apr. 22, 1986; No. 4,609,774 issued to David M. LeMieux et al. on Sept. 2, 1986; and, to No. 4,739,551, issued to Benjamin Bowsky et al. on Apr. 26, 1988, each of which patents broadly teaches the utilization of a fuse-like area incorporated as part of an inner segment of a pin and a flange member associated therewith. In addition, attention is directed to U.S. Pat. No. 4,461,925, issued to Benjamin Bowsky et al. on July 24, 1984, which patent teaches a terminal pin having a stop flange associated therewith and which further includes a reduced area positioned immediately adjacent the outside area of the seal and cup-shaped body with no mention being made in this patent of a fuse guard and lead wire securing arrangement. Finally, attention is directed to U.S. Pat. No. 3,160,460, issued to A. Wyzenbeek on Dec. 8, 1964 which broadly suggests a terminal block arrangement for a terminal assembly which guards an outer pin segment but which does not include or suggest a fuse incorporation remote from the outer pin segment, protection against terminal assembly leakage or sealing of the terminal block to the housing wall.

In accordance with the present invention, it is recognized that, as suggested in the earlier Bowsky et al. U.S. Pat. No. 4,461,925, it is desirable to locate the fuse-like area adjacent the outer face of the cup-shaped body of a terminal assembly to keep abnormally excessive currents from reaching and melting the glass which serves to form a seal between the pin and cup-shaped body of the terminal assembly. It further is recognized by the present invention that, if the glass seal between pin and cup-shaped body reaches an elevated temperature before softened or molten state, it offers a path for a trickle current and eventually this could allow the terminal assembly to vent to ambient. Such a desirable relative location of the fuse-like area of the pin of the terminal assembly outside the cup-shaped body not only has not been utilized in the more recent past, but, as is reflected in the structure disclosed in the aforementioned later issued patents to Bowsky et al., namely U.S. Pat. Nos. 4,584,433 and 4,739,551, the fuse-like area incorporated in the pin has been located on the inner segment of the terminal assembly pin, usually between a comparatively costly to manufacture stop-flange and the extremity of the inner segment of the pin, notwithstanding such glass melting problems. The present invention, recognizing the desirability of the location for the fuse-like area on the outer face or outside of the terminal assembly and further recognizing the reason for avoiding such selection in the recent past, provides a novel structure which obviates these now recognized problems, the present invention including the utilization of a novel, terminal block arrangement for covering the exposed outer segment of a pin such means functioning like a terminal block and further serving as a pin restraint during normal operations to avoid usage of the comparatively costly and more difficult to assemble stop-flange on the inner segment of the terminal pin and the cumbersome and comparatively difficult to assemble outer pin segment guard assemblies mounted on outer housing walls in past arrangements. In addition, the present novel terminal block arrangement provides a unique current resistive guard and wire securing arrangement for the outer segment of the pin means and wire connections of a terminal assembly which includes a protected fuse area therein, which in the event of fuse melt, serves to hold the lead wire ends in position to help prevent free floating of electrically alive wires. Further, the present invention, not only provides a novel, comparatively inexpensive to manufacture and assemble current resistive, integral guard assembly for the external segments of otherwise exposed outer pin segments of a terminal assembly, but also provides a novel means for readily mounting such integral guard assembly allowing the same to be bonded or fastened firmly in place to restrict ready access thereto, thus helping to minimize some of the safety problems which can arise through amateur repair attempts.

Various other features of the present invention will become obvious to one skilled in the art upon reading the disclosure set forth herein.

SUMMARY OF THE INVENTION

More particularly, the present invention provides in combination with a hermetic terminal assembly having a body member sealed in a housing wall with protruding outer pin segment means extending from the body member externally of the housing wall, a current resistive terminal block, the terminal block including a main channel having an aperture therein sized to engagingly receive and protect the outer pin segment means within the main channel means and to act as a diffuser in the event of terminal assembly leakage, the main channel means having subchannel means communicatively extending therefrom to accommodate outside lead wire end connection means including protected fuse means to be fastened to the outer pin segment means. In addition, the present invention provides a unique arrangement for the subchannel means including a plurality of elongated subchannels with the subchannels arranged in stacked communicatively connected segments to allow the fuse to be included in the lead wire end connection for each stacked subchannel so as to be located at a position remote from the main channel and the protected outer pin segment therein in the event of arcing upon the possible occasion of fuse melt.

It is to be understood that various changes can be made by one skilled in the art in one or more of the several parts of the apparatus disclosed herein without departing from the scope or spirit of the present invention. For example, the main channel accommodating the outer pin segments could be centrally disposed with communicating spaced subchannels extending outwardly in radial arcs therefrom.

BRIEF DESCRIPTION OF THE DRAWINGS

Referring to the drawings which disclose one advantageous embodiment of the present invention and a modified embodiment thereof.

DETAILED DESCRIPTION OF THE DRAWINGS

Figure 1:
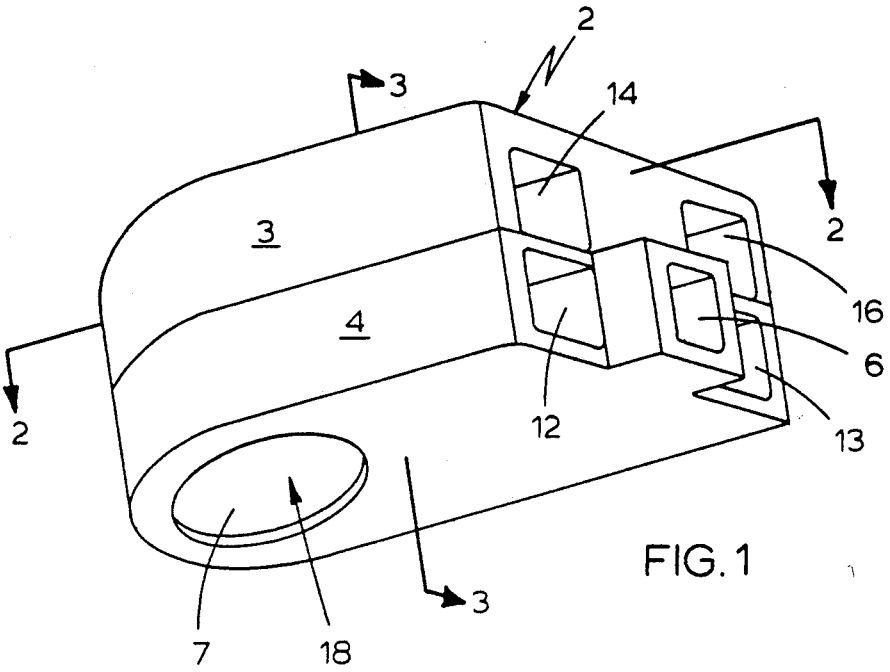
FIG. 1 is an isometric view of the inventive terminal block looking upwardly toward the bottom face thereof.
Figure 3:
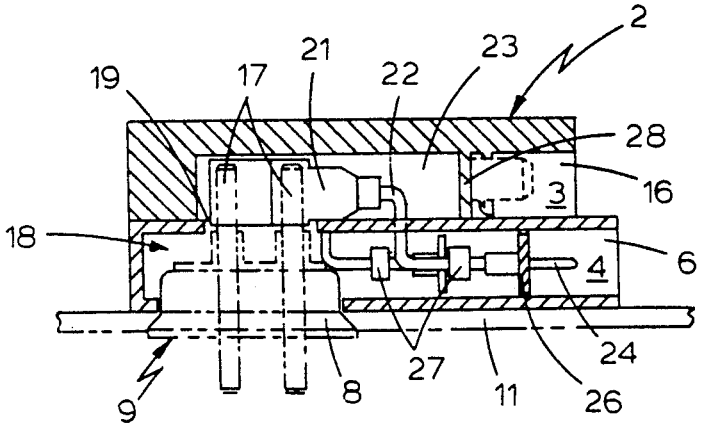
FIG. 3 is a cross-sectional view taken in a plane through line 3—3 of FIG. 2 of the terminal block of FIG. 2 bonded to a housing wall and the hermetic terminal assembly sealed in the housing wall projecting into the block.

Referring to FIG. 1 of the drawings, an advantageous embodiment of an inventive terminal block 2 is disclosed as including stacked upper block segment 3 and lower block segment 4. The upper and lower segments 3 and 4 can be made from any one of a number of appropriately specified current resistive materials, such as a suitable General Electric Company Noral SE1 plastic or an equivalent plastic material. The geometric confirmation of the terminal block 2 can also vary in accordance with the hermetic terminal assembly and housing to which it is to be mounted. In the instant embodiment, the upper and lower segments 3 and 4 which are bonded to each other are similar in geometric confirmation with the exception that the lower segment 4 is provided with an open-ended extension 6 and an aperture 7 in the lower or under face thereof sized to nestingly receive a portion including the base and part of the skirt or rim of a cup-shaped body member 8 of a hermetic terminal assembly 9 which assembly 9 is sealed in the wall 11 of a hermtically sealed housing such as the outer wall of a compressor (FIG. 3). In addition to open-ended extension 6 in lower segment 4, each segment 3 and 4 can be provided at one side end thereof with a set of spaced openings, the lower segment 4 having spaced openings 12 and 13 on either side of open-ended extension 6, all three of such openings serving as passages for lead wire end connections to be described hereinafter. The upper segment 3 is shown as provided with two spaced openings 14 and 16 for insertion and connection of auxiliary wiring, also to be described hereinafter. It is to be understood that stacked upper and lower block segments 3 and 4 can be bonded together at their abutting faces by any one of a number of suitable adhesive materials or that it would even be possible to form the stacked, two-tiered terminal block as an integral unit rather than in two bonded parts.

Figure 2:
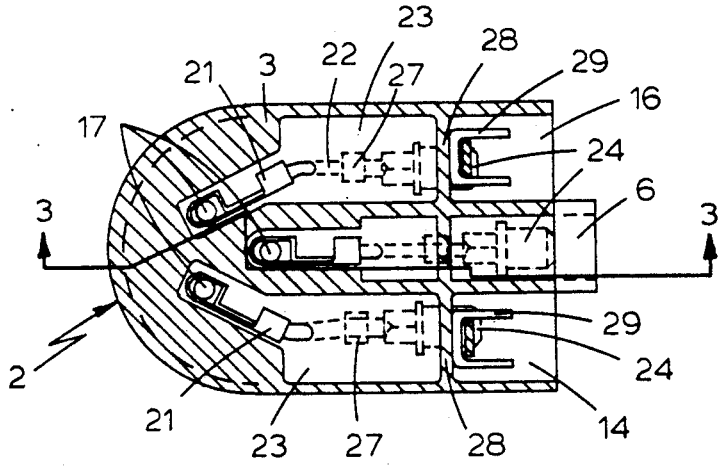
FIG. 2 is a somewhat reduced cross-sectional view taken in a plane through line 2—2 of FIG. 1 of the terminal block in engagement with the outer pin segments of a hermetic terminal assembly and showing in broken lines the lead wire end connections in the lower segment of the terminal block.

Referring to FIGS. 2 and 3 of the drawings, it can be seen that hermetic terminal assembly 9 sealed to housing wall 11 includes three (3) spaced outer pin segments 17 extending from the cup-shaped body member 8 along a main channel 18 which extends through lower block segment 4 of terminal block 2 into upper block segment 3 of terminal block 2, an aperture 19 communicatively connecting upper and lower segments 3 and 4 being sized to allow free passage of outer pin segments 17 into upper segment 3. The end portions of pin segments 17 each engage in a contact loop of an electrical end connector 21 which forms part of an electrical lead wire connection 22. Each electrical lead wire end connection 22 is encased in one of three spaced subchannels 23 which extend in lateral fashion from main channel 18. It is to be noted that each subchannel 23 includes an upper subchannel segment located in the upper block segment 3 of terminal block 2 and a lower subchannel segment located immediately below the upper segment in the lower block segment 4 of terminal block 2 so that three pairs, each comprised of stacked upper and lower subchannel segments are provided in terminal block 2 to encase three lead wire end connections 22 in extended Z-fashion with the lead wire end connections 22 passing through appropriate apertures in the wall between corresponding upper and lower subchannel segments. One end of each lead wire end connection 22 is connected to an outer pin segment 17 by looped end connector 21. The other end of each of the lead wires is provided with an electrical contact tab 24 fixed firmly in position by a crosswall 26 adjacent each of the openings 6, 12 or 13 and to which the lower subchannels segments of subchannels 23 extend. In accordance with one feature of the present invention each lead wire end connection 22 is provided with a fuse-like area 27 fastened in series intermediate the extremities thereof so as to be positioned in the lower segment of each subchannel 23 at a location remote from the outer pin segment 17 to reduce possible arcing mishaps in the event of fuse melt due to abnormally excessive current loads. It is to be noted that openings 14 and 16 in the upper segment 3 of terminal block 2 serve as open-ended access cavities to each include a cross-wall 28 on which is mounted a U-shaped clip 29 to which auxiliary electrical connections can be fastened.

Figure 4:
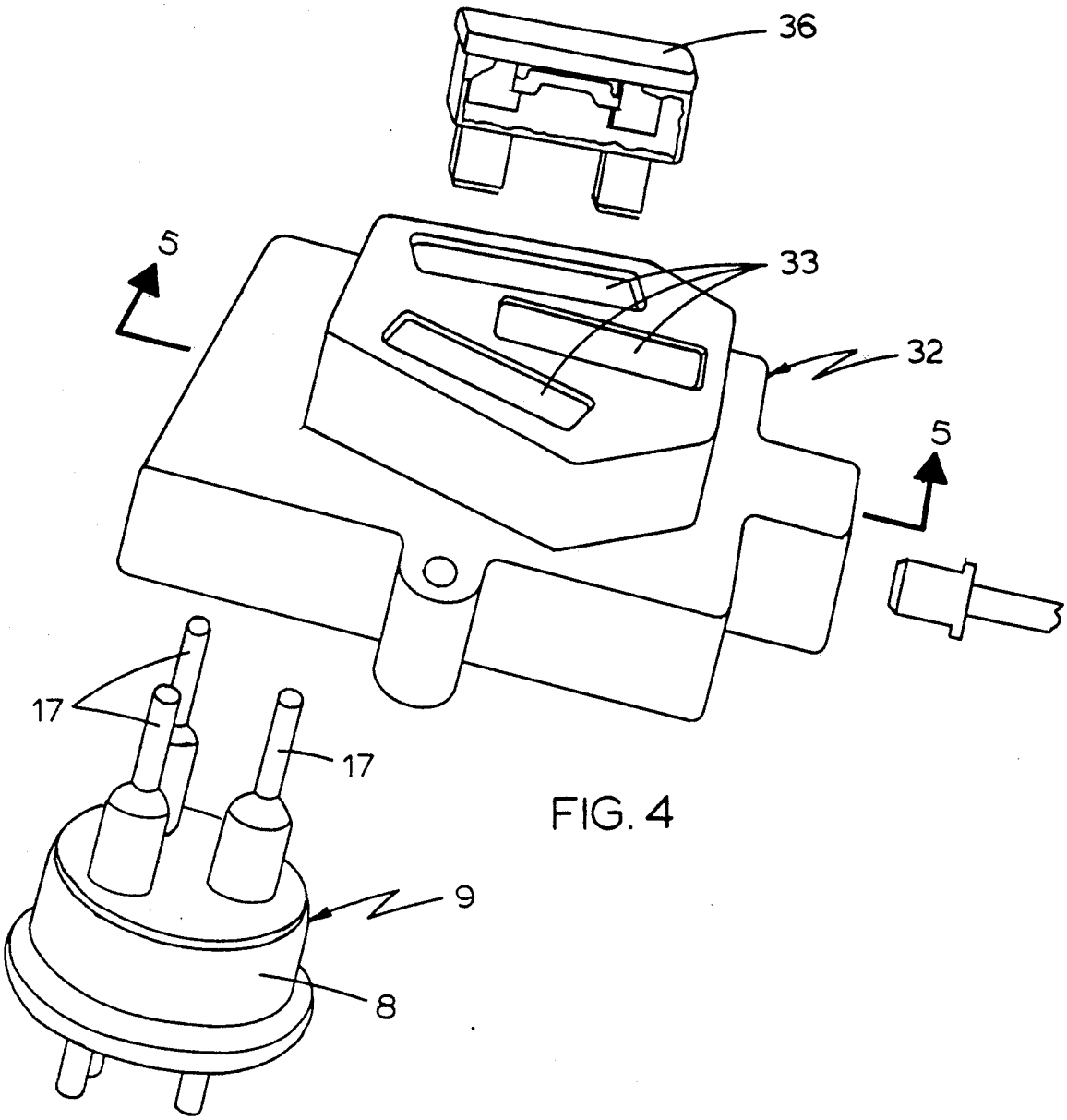
FIG. 4 is an exploded isometric schematic view of a modified embodiment of the inventive terminal block, further disclosing a hermetic terminal assembly with which it is to engage and one of the replaceable fuse members, partially broken away, in line with one of the fuse access openings in the disclosed terminal block.
Figure 5:
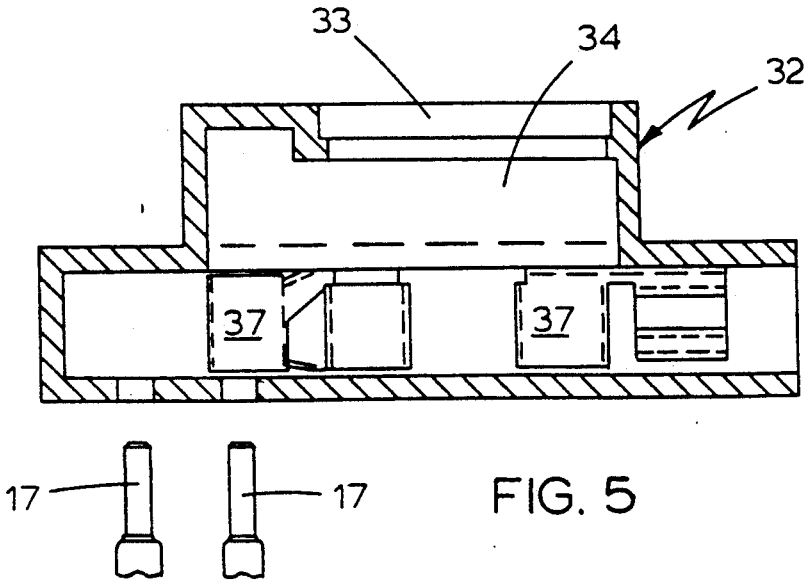
FIG. 5 is an enlarged schematic cross-sectional view taken in a plane through line 5—5 of FIG. 4, disclosing details of a fuse receptacle.

Referring to FIGS. 4 and 5 of the drawings there is schematically disclosed a modified terminal block 32 which is of slightly different configuration but which incorporates the double or stacked segment feature of terminal block 2. In this terminal block 32, the upper segments of the lateral subchannels extending from the outer pin receiving main channel are each provided with an access opening 33 on the outer face of the terminal block in communication with passage 34 leading to the stacked lower subchannel segment for insertion of a replaceable fuse 36 which engages in fast electrical connection between spaced electrical contacts 37 which are in series with a lead wire end connection, not shown in detail herein.

Thus, in accordance with the present invention a novel terminal block arrangement is provided which can be readily fastened in bonded relation to the outer pin segments of a hermetic terminal assembly sealed in an outside housing wall of a hermetically sealed compressor. This novel terminal block arrangement serves to protect the outer pin segments from ready access, diffuse possible leakage from the housing through the terminal assembly and to readily fuse the electrical system through secured lead wire connections at a location remote from the outer pin segments in the event of arcing.

The invention claimed is:

1. In combination with a hermetic terminal assembly having a body member sealed in a housing wall with protruding outer pin segment means sealed to said body member and extending from said body member externally of said housing wall, a current resistive terminal block, said terminal block including main channel means having aperture opening means on one face of said block sized to engagingly receive and protect said outer pin segment means within said main channel means and to act as a diffuser in the event of terminal assembly leakage, said main channel means having subchannel means communicatively extending therefrom sized to accommodate outside lead wire end connection means to be fastened to said outer pin segment means including fuse means in series with said lead wire end connection means whereby said fuse means is located in a position remote from said protected, outer pin segment means.

2. The terminal block of claim 1, said aperture opening means on one face of said terminal block being sized and configured to engagingly receive said body member of said hermetic terminal assembly with said one face of said terminal block engaging one face of said housing to abutting planar contact therewith to be bonded into such abuttingly engaged position relative said housing wall.

3. The terminal block of claim 1, said fuse means in series with said lead wire end connection means being a replaceable fuse means, said subchannel means having an access opening therein for insertion of said replacable fuse means into electrical connection with said lead wire end connection means and said outer pin segment means.

4. The terminal block of claim 1, said terminal block assembly including an open-ended access cavity to accommodate a terminal clip to which auxiliary electrical connections may be fastened.

5. The terminal block of claim 1, said subchannel means including a plurality of spaced subchannels longitudinally extending laterally from said main channel means.

6. The terminal block of claim 5, said longitudinally extending subchannels being comprised of at least two communicatively connected stacked channel segments in which said lead wire end connection means and fuse means extend in continuous elongated Z-fashion to minimize possible arcing to said main channel and said outer pin segment in the event of fuse melt.

7. In combination with a hermetic terminal assembly having a cup-shaped body member sealed in a housing wall with a portion of said cup-shaped body member including at least two spaced outer pin segments sealed to said body member extending externally of said housing wall, a current resistive plastic terminal block, said terminal block including a main protecting channel having an aperture therein on the under face thereof sized to nestingly receive said portion of said cup-shaped body member and said spaced outer pin segments to protect said pin segments and to act as a diffuser in the event of terminal assembly leakage with the under face of said terminal block abutting the outer face of said housing wall and being bonded thereto; said terminal block including at least two spaced elongated enclosed subchannels communicating with said main channel to accommodate one of at least two lead wire end connections for each of said outer pin segments with each of said lead wire end connections having a linking fuse disposed in electrical series therewith within said subchannel of said terminal block at a position remote from the pin segment to which it is connected to minimize arcing to the pin segment in the event of fuse melt.

8. The terminal block of claim 7, each of said enclosed subchannels having an access opening on the outer face of said terminal block for insertion of a replaceable fuse therein.

9. The terminal block of claim 7, said elongated enclosed subchannels including communicatively connected upper and lower stacked segments through which said lead wire end connections and their series extended fuses extend in Z-fashion with the lead wire end connections being fastened to their respective outer pin segments in the main channel at one extremity of the upper channel segment and the series connected fuse being positioned in the lower channel segment to minimize arcing in the event of fuse melt.

* * * * *